US005551400A

United States Patent [19]

Rice et al.

[11] Patent Number: 5,551,400

[45] Date of Patent: Sep. 3, 1996

[54] MOUNTING ADAPTER FOR AIR-ASSIST FUEL INJECTOR

[75] Inventors: Peter C. Rice, Yorktown; Anthony L. Franchitto, Hampton; Jingming J. Shen, Newport News, all of Va.

[73] Assignee: Siemens Automotive L.P., Auburn Hills, Mich.

[21] Appl. No.: 573,900

[22] Filed: Dec. 18, 1995

Related U.S. Application Data

[63] Continuation of Ser. No. 154,317, Nov. 18, 1993, abandoned.

[51] Int. Cl.[6] ..... F02M 55/02

[52] U.S. Cl. ..... 123/470; 123/531

[58] Field of Search ..... 123/531, 532, 123/533, 470, 472

[56] References Cited

U.S. PATENT DOCUMENTS

| | | | |
|---|---|---|---|
| 4,434,766 | 3/1984 | Matsuoka | 123/531 |
| 4,794,901 | 1/1989 | Hong | 123/533 |
| 4,945,877 | 8/1990 | Ziegler | 123/531 |
| 4,950,171 | 8/1990 | Muzslay | 123/470 |
| 5,038,738 | 8/1991 | Hafner | 123/470 |
| 5,046,472 | 9/1991 | Linder | 123/533 |
| 5,218,943 | 6/1993 | Takeda | 123/533 |

FOREIGN PATENT DOCUMENTS

| | | | |
|---|---|---|---|
| 0152168 | 9/1983 | Japan | 123/470 |
| 4401059 | 4/1992 | Japan | 123/531 |

*Primary Examiner*—Carl S. Miller
*Attorney, Agent, or Firm*—Russel C. Wells

[57] ABSTRACT

An adapter for mounting an air-assisted fuel injector on an engine is a one-piece molded plastic part that includes an integral assist-air supply tube through which assist air enters the adapter and integral attaching catches.

1 Claim, 1 Drawing Sheet

MOUNTING ADAPTER FOR AIR-ASSIST FUEL INJECTOR

This is a continuation of application Ser. No. 08/154,317 filed on Nov. 18, 1993 now abandoned.

FIELD OF THE INVENTION

This invention relates to fuel-injectors for internal combustion engines, particularly fuel injectors having air-assist nozzles for enhancing atomization of fuel as it is being injected.

BACKGROUND AND SUMMARY OF THE INVENTION

In some engines requiring air-assisted fuel injectors, the injectors are mounted in an air-assist manifold that serves all injectors. In other engines, assist air may be fed to each injector through its own tube. In both, there is a need for adaptation to the engine so that leakage is avoided.

A number of patents disclose various forms of individual adapters for individually mounting an air-assist type fuel injector on an engine. For example, please refer to U.S. Pat. No. 5,218,943. One known adapter comprises a metal receptacle for receiving the nozzle end of a fuel injector and a metal tube that is joined by a process such as brazing, welding, etc. to a hole in the sidewall of the receptacle for communicating assist air to an axially sealed zone inside the receptacle surrounding assist air entrances of the air-assist nozzle.

While the use of metal pads in an adapter may be acceptable, care must be taken during the fabrication process to guard against the creation of sharp edges, burrs, weld spatter, etc., which may have the potential for damaging seals that are necessary in order to provide proper sealing of the injector to the adapter and of the adapter to the engine. Likewise, care must be exercised to assure compliance with the typically tight tolerances that are involved in fitting to an injector and to an engine. Naturally, these measures may be reasonably anticipated to add to the cost of the adapter and its installation. Avoidance of these measures is apt to make an air-assist fuel injection system more competitive.

Development of a fuel injection system for an engine may involve substitution of parts in order to arrive at the best possible combination. The ability to quickly and conveniently make substitutions of fuel injector system components should contribute to a decrease in the development time and should enhance the ability to substitute fuel injector system components at anytime, such as after the engine has gone into service.

Briefly, the invention involves the creation of an adapter for adapting an air assist nozzle of a fuel injector to an engine by using a molding process like injection molding to create a one-piece molded plastic adapter. The resultant adapter possesses certain structural features not found in earlier adapters. One important feature is the snap-on, snap-off attachment of the adapter to an air-assist fuel injector. This feature is provided by integrally formed catches. The use of plastic injection molding also offers the potential for avoiding sharp edges, burrs, etc. Because the adapter is one-piece, it does not have to be fabricated by joining several individual components together.

The foregoing features, advantages, and benefits of the invention, along with additional ones will be seen in the ensuing description and claims which are accompanied by a drawing that shows a presently preferred embodiment of the invention according to the best mode presently contemplated for carrying out the invention.

DESCRIPTION OF THE PREFERRED EMBODIMENT

Figure 1:
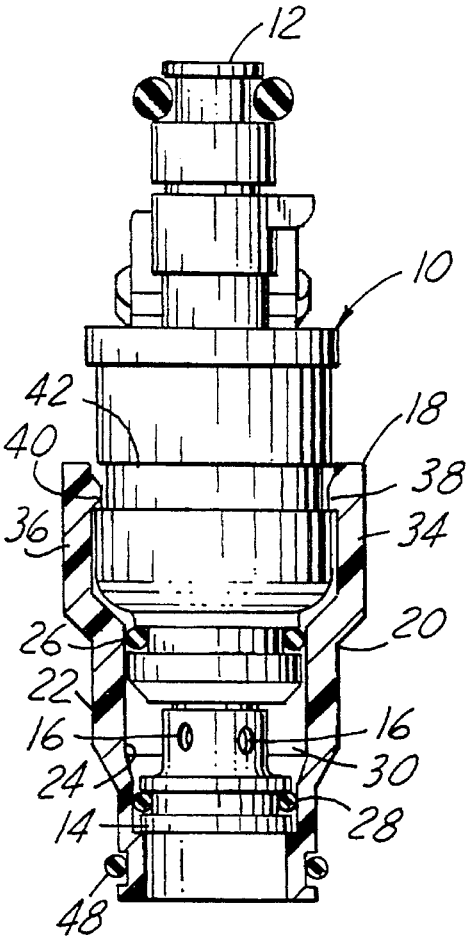
FIG. 1 is a longitudinal view of an air-assist fuel injector and includes in cross-section an adapter in accordance with principles of the invention.
Figure 2:
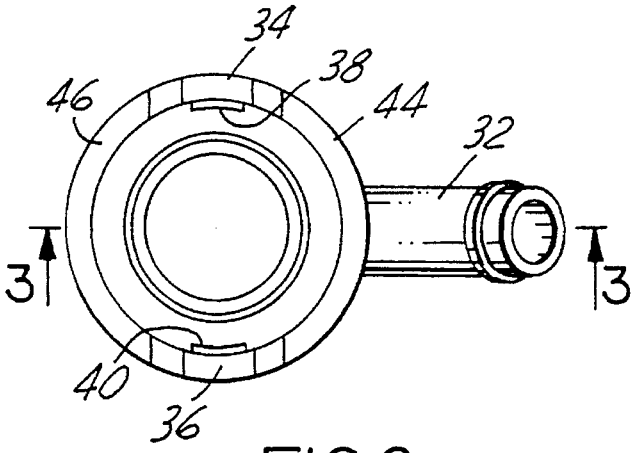
FIG. 2 is a top plan view of the adapter by itself.
Figure 3:
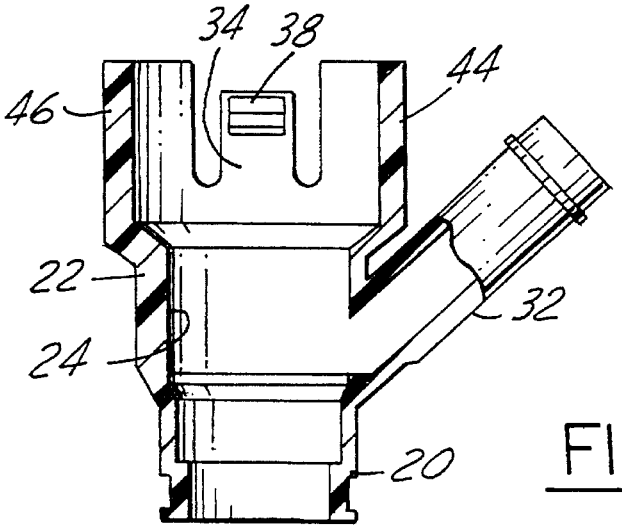
FIG. 3 is a cross-sectional view in the direction of arrows 3—3 in FIG. 2.

FIG. 1 shows a top-feed fuel injector 10 comprising an inlet tube 12 via which pressurized fuel enters and an air-assist nozzle 14 from which fuel is injected. Nozzle 14 comprises several entrances 16 via which assist air enters nozzle 14.

An adapter 18 is assembled onto fuel injector 12, fitting over nozzle 14, as shown in FIG. 1. Adapter 18 comprises a one-piece body 20 of fuel-compatible plastic that has a circular wall 22 circumferentially girdling a through-bore 24 that receives the nozzle end of the fuel injector. Axially spaced apart O-ring seals 26, 28 disposed around the outside of the fuel injector seal between the outside of the nozzle sidewall and the inside of wall 22 to axially bound and seal an annular zone 30 that is radially inwardly bounded by the outside of the nozzle and radially outwardly bounded by the inside of wall 22. Entrances 16 are open to this zone 30.

Assist air is delivered to zone 30 through a tube 32 that transversely intersects wall 22 for conveying assist air from an external source through wall 22 to zone 30 from whence it can pass into entrances 16 to act on the injected fuel.

Attachment of adapter 18 to fuel injector 10 is provided by two fingers 34, 36 diametrically opposite each other that join with and project axially from wall 22 toward the fuel injector inlet. The distal ends of fingers 34, 36 contain catches 38, 40 on their radially inner faces that catch in a circumferential groove 42 extending around fuel injector 10. Body 20 further has two additional wall sections 44, 46 that join with and extend axially from wall 22. Wall sections 44, 46 are circularly curved in shape and are interdigitated with fingers 34, 36. The fingers 34, 36 and the wall sections 44, 46 circumferentially girdle an entrance portion of through-bore 24 via which the adapter is assembled onto and disassembled from the fuel injector, although sections 44, 46 extend slightly beyond the distal ends of the fingers. Catches 38, 40 have tapered surfaces that engage the outside of the fuel injector body as the adapter is being assembled onto the fuel injector to facilitate the assembled. Fingers 34, 36 are cantilever-mounted to flex slightly during assembly, until catches 38, 40 come to groove 42, at which point the flexed fingers relax to lodge the catches in the groove.

Adapter 18 is fabricated by injection molding a suitable plastic that can withstand the fuels and temperatures encountered in use. The parts of the adapter that have been illustrated and described are integrally formed during the molding process that creates the one-piece part. This is a significant improvement over prior adapters.

The adapter can be conveniently installed, and conveniently removed when necessary. For best sealing in installed position, the outside of the adapter has an O-ring seal 48 around it proximate the end through which the injected fuel passes.

What is claimed is:

1. A mounting adapter for an air-assist fuel injector having one or more air-assist entrances through the valve body for receiving assist air to act on fuel within the fuel injector, the adapter comprising:

a tubular body of fuel-compatible plastic, with main wall means circumferentially girdling a main through-bore for receiving a portion of the fuel injector containing the assist air entrances, said main wall means cooperating with the fuel injector to form an annular zone around the air-assist entrances in the fuel injector;

a tube attached to and transversely intersecting said wall means for conveying assist air from an external source through said wall means to said annular zone;

axially spaced apart seals acting between said main wall means and the fuel injector to axially bound and seal said annular zone in a fluid tight manner;

seal retaining means on the outside of said body for locating another seal for sealing the adapter in a manifold; and resilient catch means projecting from said wall means for catching said body on the fuel injector and for locating said annular zone relative to said assist air entrances in the fuel injector.

* * * * *